US005321863A

United States Patent [19]

Yamaguchi et al.

[11] Patent Number: 5,321,863

[45] Date of Patent: Jun. 21, 1994

[54] BATH TOWEL FOR BABIES

[75] Inventors: Sumiko Yamaguchi; Takumichi Yamaguchi; Keiko Hirasawa, all of Fuji, Japan

[73] Assignee: Mammy Art Co., Ltd., Fuji, Japan

[21] Appl. No.: 63,722

[22] Filed: May 20, 1993

[30] Foreign Application Priority Data

May 21, 1992 [JP] Japan ..... 4-40275

[51] Int. Cl.[5] ..... A47G 9/06

[52] U.S. Cl. ..... 5/655; 2/69.5

[58] Field of Search ..... 5/494, 417, 420, 482, 5/655; 2/69, 69.5, 114; 15/209.1, 210.1

[56] References Cited

U.S. PATENT DOCUMENTS

| | | | |
|---|---|---|---|
| 1,678,125 | 7/1928 | Peterscu | 5/413 |
| 4,125,903 | 11/1978 | Farrell | 2/69.5 |
| 4,979,250 | 12/1990 | Troncone et al. | 5/494 |
| 5,062,168 | 11/1991 | Kocib | 5/413 |

*Primary Examiner*—Alexander Grosz

*Attorney, Agent, or Firm*—Oblon, Spivak, McClelland, Maier & Neustadt

[57] ABSTRACT

A bath towel for babies includes a body portion which has a longitudinal length large enough to cover a baby when being folded upward and auxiliary portions integral with the body portion and having a size large enough to wipe the head and face of the baby.

9 Claims, 3 Drawing Sheets

BATH TOWEL FOR BABIES

BACKGROUND OF THE INVENTION

1. Field of the Invention

This invention relates to a bath towel for toweling off a baby or a child of up to about four years.

2. Description of the Prior Art

Bath towels of this type generally have a length of about 120 cm and a width of about 60 cm. A baby cannot towel itself and after bathing tends to perspire profusely, particularly from the head. Therefore, its mother, for example, has to wipe the perspiration from its head.

A typical conventional bath towel is shown in FIG. 4 and designated by reference numeral 1. The baby is laid face up on the towel 1 and the lower half 2 of the towel is folded upward to cover the baby. For this reason, the triangular portions 3 of the towel 1 defined by the phantom lines in FIG. 4 on the opposite sides of the head of the baby become the areas used for wiping the baby's head and face. The areas 3 have to be folded along the phantom lines when used to wipe the baby's head. This is troublesome and, moreover, the triangular areas 3 are too small for the job.

This invention has been proposed to solve this problem encountered by the prior art and has as its object to provide a bath towel enabling the head and face of a baby to be wiped free of perspiration.

SUMMARY OF THE INVENTION

To attain the above object, this invention provides for a bath towel for babies, comprising a body portion which has a longitudinal length large enough to cover a baby when folded upward and auxiliary portions which are integral with the body portion and have a size large enough for wiping perspiration from the baby's head and face.

The above and other objects, characteristic features and advantages of this invention will become apparent to those skilled in the art from the description of the invention given hereinbelow with reference to the accompanying drawings.

DETAILED DESCRIPTION OF THE PREFERRED EMBODIMENTS

This invention will now be described in detail with reference to the accompanying drawings.

Figure 1:
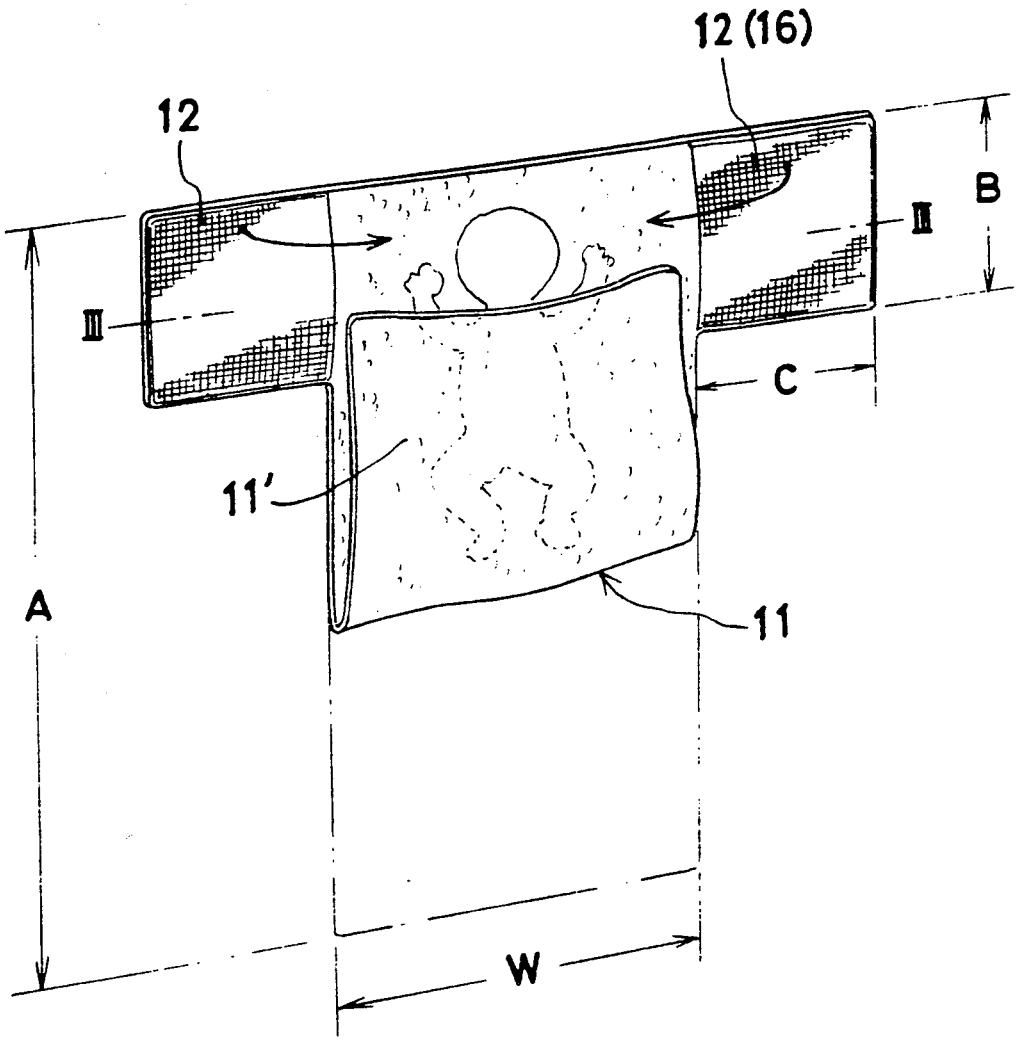
FIG. 1 is an explanatory view showing how one embodiment of the bath towel according to this invention is used.

As shown in FIG. 1, a bath towel of the first embodiment according to this invention comprises a body portion 11 having a longitudinal length large enough to cover a baby when folded upward and a pair of auxiliary portions 12 extending integrally from the opposite sides of the upper part of the body portion 11 to form a T-shape as a whole. In this embodiment, the body portion 11 has a longitudinal length A of about 120 cm and a width W of about 60 cm, for example, and the auxiliary portions 12 have a longitudinal length B of about 30 cm and a lateral length C of about 30 cm. When the lower half 11' of the body portion 11 is folded upward, it can cover a baby from the feet to the neck. In the case of a three or four-year-old child, it suffices if the lower half 11' folded of the body portion 11 folded back between the legs to cover the child from the crotch to the middle of the stomach.

In use, a baby is laid face up on the bath towel so that its head is positioned on the upper end side of the body portion 11, then the lower half 11' of the body portion 11 is folded upward to cover the baby, and the head and face are wiped with the pair of auxiliary portions 12. Since each of the pair of auxiliary portions 12 is connected to, but extends independently away from one side of the body portion 11, it can be folded at the boundary between itself and the body portion 11 and directed to the head and face of the baby without interference from the body portion 11. Therefore, the head and face of the baby can be wiped thoroughly with the auxiliary portions 12.

The body portion and auxiliary portions constituting a bath towel for children are made of the same toweling material. In the case for a bath towel for babies, however, these portions are desirable made of a soft and smooth material which absorbs moisture well. Examples include gauze and silk cloth. Optionally, the bath towel may comprise a body portion made of toweling and auxiliary portions made of gauze or silk cloth and sewed to the body portion.

Figure 2:
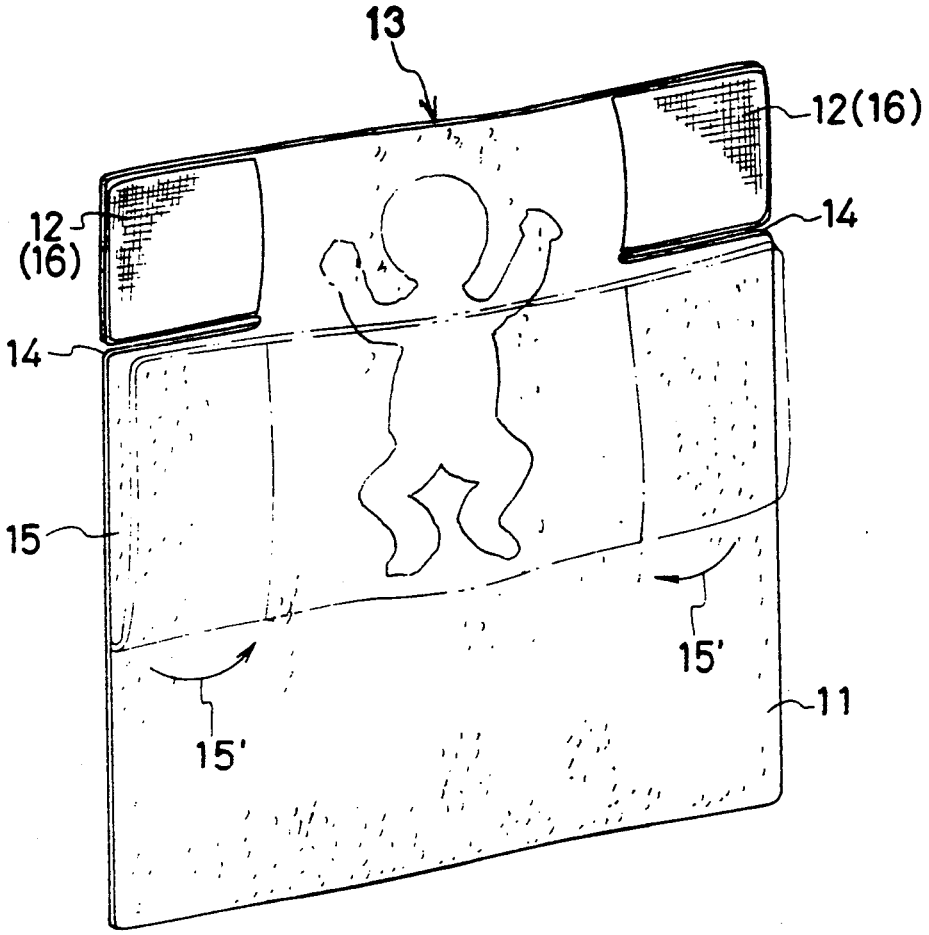
FIG. 2 is a plan view showing another embodiment of the bath towel according to this invention.

The second embodiment of the bath towel according to this invention will be described with reference to FIG. 2.

The bath towel is made of a square cloth 13 (toweling, gauze or silk cloth) measuring about 120 cm per side. The cloth 13 is cut from the opposite sides toward the center thereof at a position about 30 cm from the top end thereof substantially in parallel to the top end to form a pair of slits 14 having a length of about 30 cm. That is to say, the part of the cloth 13 below the slits 14 serves as the body portion 11 of the first embodiment and the parts of the cloth 13 above the slits 14 function as the pair of auxiliary portions 12 of the first embodiment.

The bath towel of the second embodiment can be used in the same manner as that according to the first embodiment. In the second embodiment, however, the body portion can be used as a baby wrap by folding the lower half upward to cover the baby and folding the opposite sides 15 over the baby as shown by arrows 15' in FIG. 2.

Figure 3:
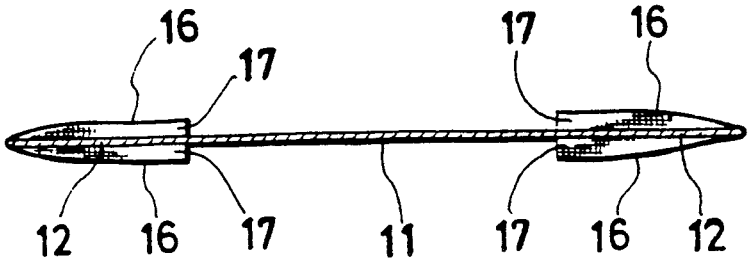
FIG. 3 is a cross-sectional view taken along line III—III in FIG. 1.
Figure 4:
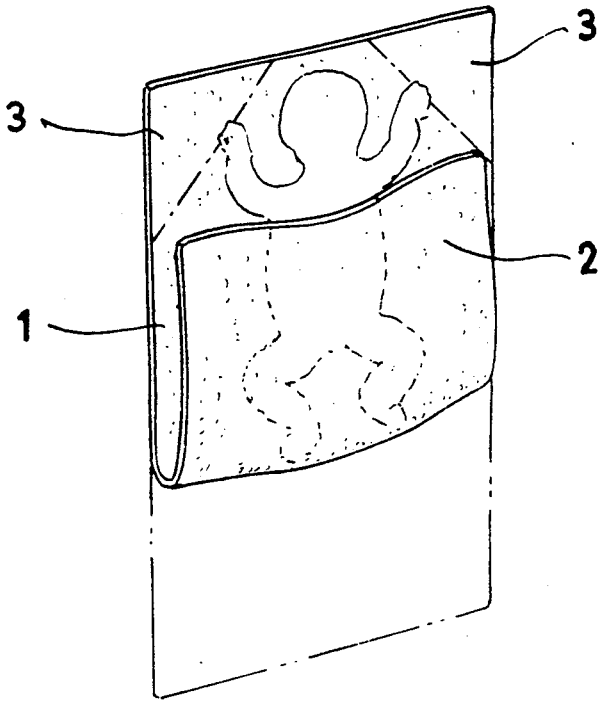
FIG. 4 PRIOR ART
FIG. 4 is an explanatory view showing a prior art bath towel in use.

As shown in FIG. 3, in either of the embodiments described above, each of the auxiliary portions 12 may have its opposite surfaces covered by pieces of cloth 16 to form pockets 17 for insertion of the hand of the mother, for example. In this case, wiping of the head and face of the baby with the auxiliary portions 12 can be facilitated by utilizing the pockets 17 on the surface opposite the surface of the auxiliary portions 12 on which a baby lies. When the auxiliary portions 12 are made of toweling, the cloth 16 for the pockets 17 is desirably soft and smooth gauze or silk cloth.

The auxiliary portions 12 and part of the body portion 11 between the auxiliary portions 12 may be made of gauze or silk cloth and attached by sewing or any other means to the remaining part of the body portion 11 made of toweling.

As has been described in the foregoing, the bath towel according to this invention has a body portion for covering a baby and a pair of auxiliary portions for wiping the head and face of the baby and, since the auxiliary portions are connected to and independently extend from the body portion, they can readily be folded toward the baby's head so that their entire area can be used for thoroughly wiping the baby's head and face.

What is claimed is:

1. A bath towel for babies, comprising:

a body portion which has a longitudinal length large enough to cover a baby when folded upward; and auxiliary portions integral with said body portion and having a size large enough for wiping the head and face of the baby;

wherein:

said body portion has a pair of slits cut from opposite sides toward a center thereof at an upper position substantially in parallel to a top end thereof, and parts of said body portion above said pair of slits constitute said auxiliary portions; and said auxiliary portions have opposite surfaces thereof covered by pieces of cloth to form pockets on said opposite surfaces.

2. A bath towel for babies according to claim 1, wherein said auxiliary portions are made of gauze.

3. A bath towel for babies according to claim 1, wherein said auxiliary portions are made of a silk cloth.

4. A bath towel for babies, the bath towel comprising:

a generally rectangular body portion having a width large enough to permit a baby to be laid thereon and a longitudinal length large enough to permit a baby's head to be positioned on an upper part of the body portion when the baby is laid on the bath towel and permit a lower part of the body portion to substantially cover the baby when the lower part is folded upward; and generally rectangular auxiliary portions extending from opposite sides of the upper part of said body portion, each of said auxiliary portions having an upper edge which is coextensive with an upper edge of said body portion, each of said auxiliary portions having a width which is approximately half of the width of said body portion and a length which is substantially equal to said width of said auxiliary portions and being foldable along a boundary between each of said auxiliary portions and said body portion for directing each of said auxiliary portions to the baby's head for wiping the head and face of the baby with the auxiliary portions.

5. A bath towel for babies according to claim 4, wherein said auxiliary portions are made of gauze.

6. A bath towel for babies according to claim 4, wherein said auxiliary portions are made of a silk cloth.

7. A bath towel for babies, the bath towel comprising:

a generally rectangular body portion having a width large enough to permit a baby to be laid thereon and a longitudinal length large enough to permit a baby's head to be positioned on an upper part of the body portion when the baby is laid on the bath towel and permit a lower part of the body portion to substantially cover the baby when the lower part is folded upward; and generally rectangular auxiliary portions positioned at opposite sides of the upper part of said body portion, said body portion comprising a pair of slits cut from opposite sides toward a center of the body portion, said slits defining a first boundary between the upper and lower parts of the body portion with parts of said body portion above said pair of slits constituting said auxiliary portions, each of said auxiliary portions having an upper edge which is coextensive with an upper edge of said body portion, each of said auxiliary portions having a width which is approximately half of the width of the upper part of the body portion and a length which is substantially equal to said width of said auxiliary portions and being foldable along a second boundary between each of said auxiliary portions and the upper part of the body portion for directing each of said auxiliary portions to the baby's head for wiping the head and face of the baby with the auxiliary portions.

8. A bath towel for babies according to claim 7, wherein said auxiliary portions are made of gauze.

9. A bath towel for babies according to claim 7, wherein said auxiliary portions are made of a silk cloth.

* * * * *